United States Patent [19]

Flament

[11] Patent Number: 4,911,430

[45] Date of Patent: Mar. 27, 1990

[54] MUSCLE TRAINING APPARATUS

[76] Inventor: Jean Marie Flament, 28 rue de Lucheux, 62172 Bouvigny-Boyeffles, France

[21] Appl. No.: 101,179

[22] PCT Filed: Jan. 26, 1987

[86] PCT No.: PCT/FR87/00027

§ 371 Date: Aug. 25, 1987

§ 102(e) Date: Aug. 25, 1987

[87] PCT Pub. No.: WO87/04360

PCT Pub. Date: Jul. 30, 1987

[30] Foreign Application Priority Data

Jan. 28, 1986 [FR] France ..... 86 01411

[51] Int. Cl.[4] ..... A63B 69/18

[52] U.S. Cl. ..... 272/97; 434/253

[58] Field of Search ..... 272/97, 70, 69, 72, 272/146, 96, 127, 93; 128/25 R, 25 B; 434/253

[56] References Cited

U.S. PATENT DOCUMENTS

| | | | |
|---|---|---|---|
| 2,006,350 | 7/1935 | Gartner | 272/96 |
| 2,455,274 | 11/1948 | Scriver | 272/57 |
| 3,364,875 | 1/1968 | Bilaisis | 272/97 |
| 3,421,760 | 1/1969 | Freeman | 272/96 |
| 3,462,141 | 8/1969 | Robbins | 272/57 |
| 3,704,885 | 12/1972 | Raciunas | 272/57 B |
| 4,252,312 | 2/1981 | Dehan | 272/97 |
| 4,376,532 | 3/1983 | Hunstad | 272/97 |
| 4,607,839 | 8/1986 | Knudson | 272/97 |
| 4,632,385 | 12/1986 | Geraci | 272/70 |

FOREIGN PATENT DOCUMENTS

| | | | |
|---|---|---|---|
| 2001557 | 7/1971 | Fed. Rep. of Germany . | |
| 1595452 | 7/1970 | France | 272/97 |
| 579401 | 9/1976 | Switzerland | 272/97 |
| 579401 | 9/1976 | Switzerland . | |
| 0597377 | 3/1978 | U.S.S.R. | 272/97 |
| 2004190 | 3/1979 | United Kingdom . | |

*Primary Examiner*—Stephen R. Crow

*Attorney, Agent, or Firm*—Kerkam, Stowell, Kondracki & Clarke

[57] ABSTRACT

Muscle training apparatus allowing the user to exercise particularly his lower limbs as for training in sliding sports such as snow or water skiing, includes a base adapted to be anchored on a reference surface, the base having a arcuate shaped track formed of two concentric paths, each path having a curved concentric rail, and a pair of moveable carriages, each having grooved wheels for bearing on the concentric rails. Each carriage has a shoe connected to its upper part for articulation, the shoe being adapted to receive the foot of the user and to rotate about an axis parallel to a simulated direction of a ski. Each shoe includes a brake for blocking movement of the carriage over the track so as to a simulate an edge taking skiing technique by placing the user in a position corresponding to that actually taken during skiing.

5 Claims, 5 Drawing Sheets

_Fig:3_
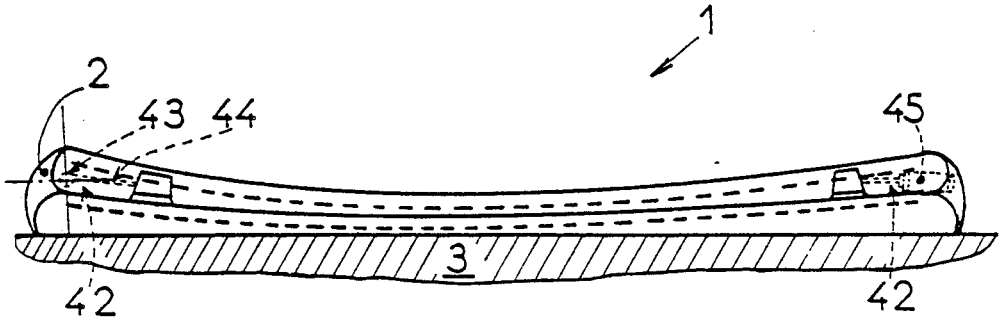
_Fig:4_
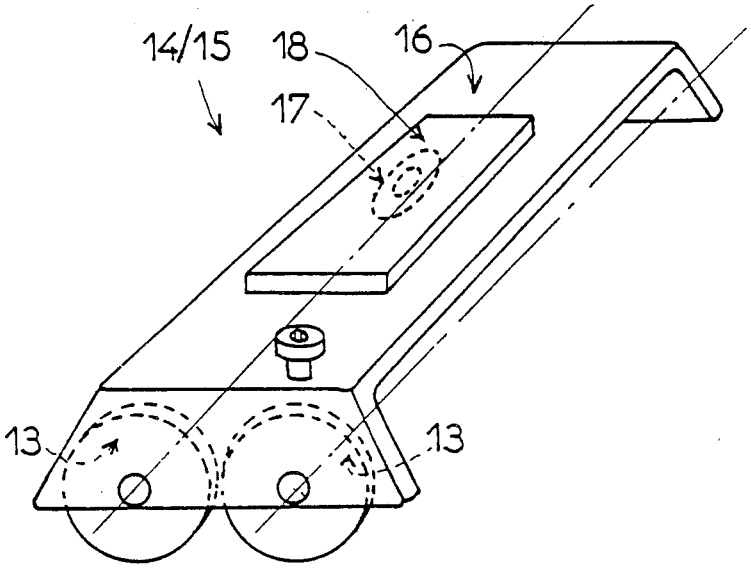

-Fig:5-
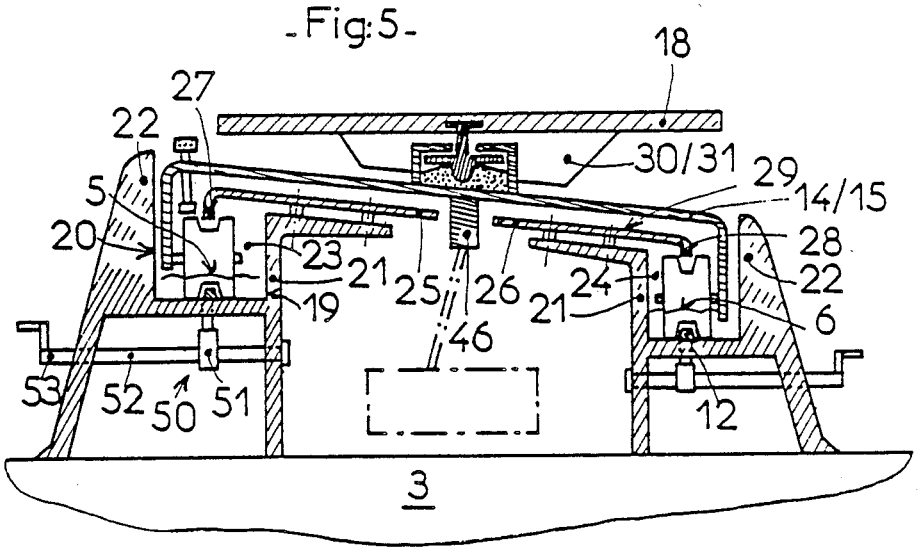
-Fig:6-
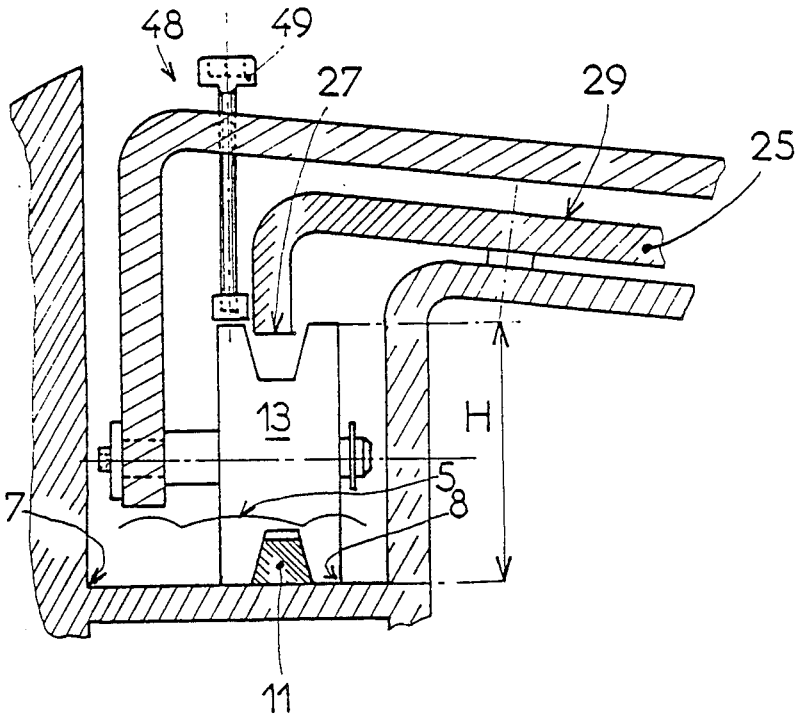

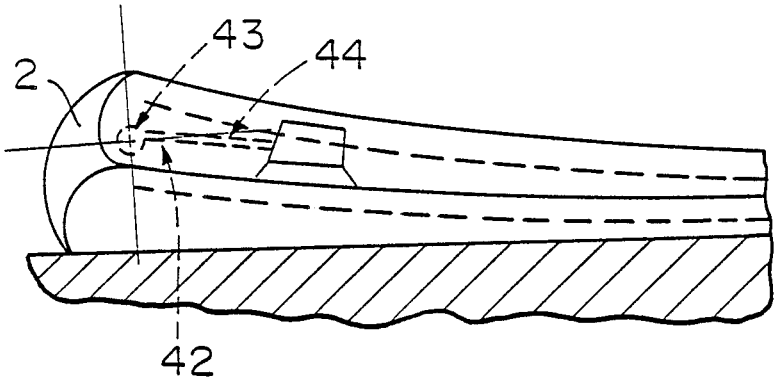
_Fig: 8_
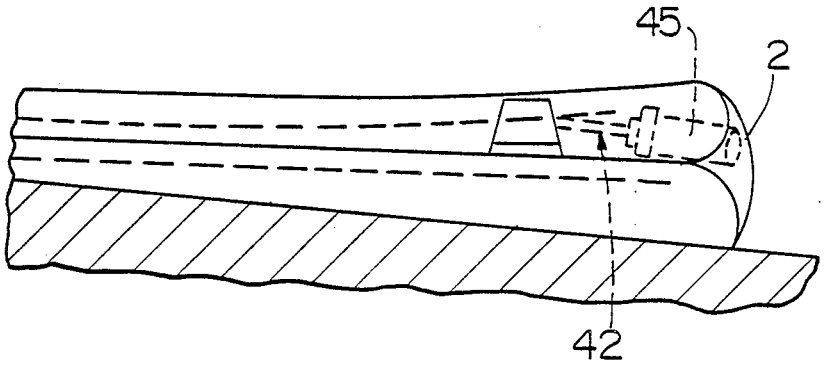
_Fig: 9_

MUSCLE TRAINING APPARATUS

BACKGROUND OF THE INVENTION

The invention relates to a muscle training apparatus allowing its user to exercise his body, especially his lower limbs for training or sporting purposes. For example, the apparatus is useful for initial instruction, perfecting and training in sliding sports such as snow or water skiing.

Different apparatus of this type are well known today. Depending on its design, such an apparatus more or less faithfully simulates movements usually made during the practice of such a sport.

One of the known apparatus (U.S. Pat. No. 2 455 274 issued to Scriver on Nov. 30, 1948) comprises a plate in the form of a circular sector resting on a substantially horizontal reference surface. A tip of the arc of this sector rests on the surface. The sector is also attached to the surface through a foot member having a hinge at its top substantially at the level of the origin of the radius of curvature of the plate.

To perform a combination of movements on Scriver's apparatus, the user's feet are only connected to the plate by means of shoes guided in translation on the top of the plate whereby they are disposed between two concentric curved reels, the reels having a curvature opposite that of the arc of the plate.

Taking into account the small degrees of freedom left to the parts of Scriver's device, it is apparent that the user can only carry out certain movements.

In addition, it should be noted that the conditions in which they are carried out are very often different than those to which the user is subjected during the real performance of his sport. When the user places his lower limbs outwardly of his fictitious path, either to one or other of the sides of a plate, the weight of the user causes the plate to slant inversely to the real slant of the ground. (The real slant of the ground is the slant which would normally be encountered when actually skiing.)

Furthermore, because of the particular guiding of the above mentioned parts, the above mentioned parts and the feet of the user cannot slant with respect to the plate.

It is apparent that this movement called "taking the edge" is of prime importance in the practice of a sliding sport such as skiing.

Consequently, although allowing a certain number of movements, this type of apparatus cannot prepare for the practice of a sport such as snow or water skiing since the sensations felt on the apparatus are quite different from those actually experienced in carrying out the sport.

An apparatus (U.S Pat. No. 4,074,903 issued Feb. 21, 1978 to de Aux) also has a slanted plated, on which shoes are directly associated by means of a ball joint. On the shoes there is provided a sole which may move parallel to the plane of the shoe in all directions but slightly and insufficient for simulating the practice of skiing. Moreover, the feet generally remain in the same position and the movements are created by actuating cylinders varying the slant of the plate.

Another known apparatus (French Pat. No. 1 595 452 to Paulus dated July 17, 1970) includes a plate which is fixed with respect to the reference surface and which has an arcuate upper surface forming a track on which two carriages move in translation.

However, instead of these carriages being, as in the first mentioned patent, guided and held between two curved rails, they rest simply on rails provided on the top of the base. The carriages are guided by two rods which, at one of their ends, are hinged substantially to the origin of the radius of curvature of the track whereas, at their other ends, they are fixed respectively to the shoes. (The origin is the center of a circle realized by extending the arc of the arcuate track upper surface into a complete circle).

Furthermore, in order to allow movement such as "taking the edge", a shoe is associated with each carriage by means guiding the shoe in translation along an axis parallel to the rod of the particular carriage and also in rotation about this same axis.

At a certain slant of the shoe, the rotation allows the carriage to be blocked in translation on the plate by the friction of a lining fixed to the shoe on at least one wheel of the carriage.

Since the origin of the radius of curvature of the track is in front or behind the track but in the plane of this track, the track is flat and substantially horizontal.

Therefore the track does not allow the user to adopt a position in which the carriage is slanted forwardly or rearwardly or to the side.

Because of the small number of degrees of freedom which such an apparatus of the Paulus design offers a user, the Paulus type of apparatus gives good results for certain movements, but the movements are nevertheless limited.

The Paulus design does not allow the skier to assume a position leaning to a greater or lesser extent upstream or downstream or an orientation of the ski different from the of the rods to be represented.

In addition, "taking the edge" by blocking at least one wheel of a shoe does not accurately simulate the actual skiing movement.

Moreover, the design of the shoe (which allows it to cause braking of at least one of the wheels of the carriage) is such that the shoe must be suitably adjusted incrementally to avoid tipping the carriage.

Finally, known apparatus do not allow one to adjust the degree of difficulty of the skiing operation depending on the experience of the user.

OBJECTS AND SUMMARY OF THE INVENTION

The purpose of the invention is to overcome the above drawbacks and in particular to provide an apparatus which better translates the different situations met with by the skier and in which "taking the edge" avoids the risk of tipping the carriage.

Another results sought by the invention is an apparatus which is adjustable so as to take into account the capacities of its user.

The invention provides an apparatus of the above mentioned type, which closely simulates this sport, wherein despite the resultant guidance of the tracks, the track rises not only at one of its front or rear sides but also at its ends.

BRIEF DESCRIPTION OF DRAWINGS

Other results and advantages will be clear from the following description given by way of non limitative example with reference to the accompanying drawings which show schematically:

FIG. 3: a front view of the apparatus,

FIG. 4: a perspective view of a shoe of the apparatus,

FIG. 5: a sectional view through A—A of FIG. 2,

FIG. 6: a local view on a larger scale of FIG. 5,

FIG. 8: an enlarged view of a left portion of FIG. 3, and

FIG. 9: an enlarged view of a right portion of FIG. 3.

DETAILED DESCRIPTION

Figure 1:
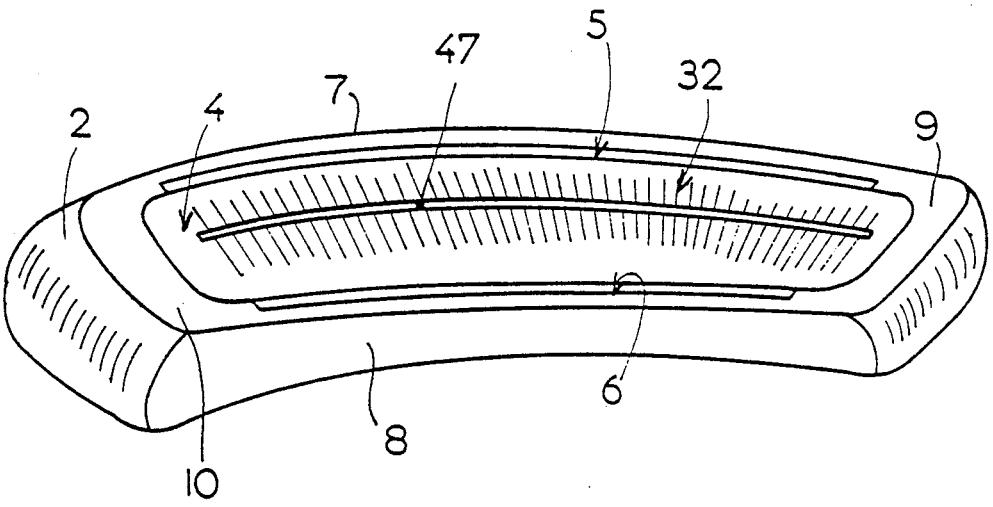
FIG. 1: a perspective view of the base of the apparatus.

Referring to the drawings, a ski simulating apparatus 1 is shown on which a user may train himself or initiate himself in sliding sports such as snow skiing, by effecting certain movements or positions conventionally met with during the practice of this sport.

This apparatus is generally formed of a base 2 providing a suitable position with respect to a reference surface 3, on which it rests or is anchored.

Base 2 has an arcuate shaped track 4 which is mainly formed of two concentric paths 5 and 6. Path 5 is said to be external and the path 6 is internal meaning that it is closer to the origin (i.e., center of the circle if arc of paths 5 or 6 is extended to 360° ) of the radius of curvature of the track.

Figure 2:
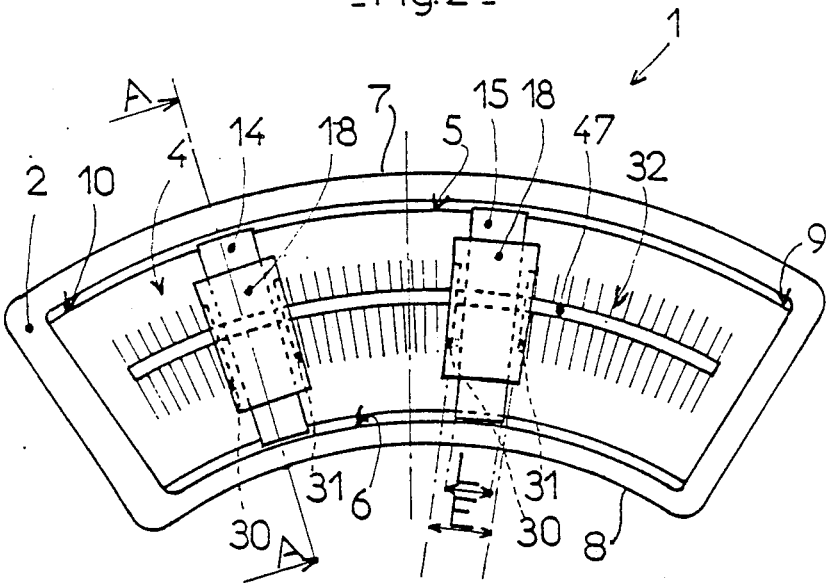
FIG. 2: a top view of the apparatus.

Paths 5 and 6 are carried by the main sections 7 and 8 (FIG. 1) of a basic structure of base 2 in which said main sections 7 and 8 are joined together by end section 9 and 10 (FIG. 2).

The origin of the radius of curvature of the track is situated in the median plane on one of the front and rear sides of the track.

On paths 5 and 6 are provided two running strips such as curved concentric rails 11 (FIG. 6), 12 (FIG. 5) on which carriages 14 and 15 move by way of running members 13 such as grooved wheels.

Each carriage, seen in profile, has an upturned U shape to the legs of which the running members 13 are connected.

Each of these carriages is provided at its upper part 16, via an articulation 17 (FIG. 4), with a shoe 18 adaptable to the footwear or directly to the foot of the user.

In a way known per se, this articulation 17 allows the shoes to rotate about an axis parallel to the fictitious or simulated direction of the skis.

The shoe is provided with means which will be described below and which ensure that, at least from a certain extent of this rotation, the movement of the carriage over the track is braked even blocked so as to represent the "edge taking" technique.

In order to place the user in the position corresponding as well as possible to that actually taken during the practice of this sport, despite the resultant guidance by the paths, the origin of the radius of curvature of the track is, in said median plane, situated above the track 4 so that the track rises not only on one of its front or rear sides but also at its ends (FIG. 3).

The raising of one of the front and rear sides, depending on the direction in which the user uses the base, allows him to slant the shoes so as to lower or raise their front ends so as to assume the positions adopted in water skiing.

During a change between snow skiing simulation and water skiing simulation (and where the shoes themselves have a direction of attachment to the carriages or to the feet of the user), the shoes will be turned around by rotation about the axes of the articulation 17 which can be a ball joint type.

The raising of the ends adds resistance to lateral movement. It also allows the beginner to train himself in "taking the edge" and, for example, in the so called staircase technique.

According to another embodiment, the articulation 17 carried by the carriage and receiving the shoe is of the ball joint type, which allows the user to direct the shoes in a direction other than in the vertical plane passing both through the origin of the radius of curvature and through the axis of the carriage. It also allows the user, with respect to the slant of the top 16 of the carriage, to slant the shoes forwardly or rearwardly so as to provide a position of the user in which he increases his slant.

The apparatus therefore adds degrees of freedom for the user and insures that any derailment is impossible. For this, each of internal 19 and external 20 sides (FIG. 5) (internal and external being defined with respect to the center of base 2) are skirted by dividing walls 21 and 22. The walls 21 and 22 situate paths 5 and 6 at the bottom of a groove 23 and 24 of width only slightly greater than the width of the running members 13 combined with the width of the legs of the carriage (most evident in side view of FIG. 6).

Thus, in addition to rails 11 and 12, the carriage is guided by said dividing walls which prevent any derailing of the carriage.

For the same purposes, on base 2, and preferably on the top of each of the internal dividing walls 21 of paths 5 and 6 an anti-derailment plate 25 and 26 (FIG. 5) is provided. The plates 25 and 26 are fixed by removable means and have, all along the path, a counter rail 27 and 28 descending towards the running strip 11 or 12 of the corresponding path 5 or 6 up to a height "H" scarcely greater than the rolling diameter of the running members 13 or generally greater than the diameter of the bottom of the groove guiding the wheels.

This ensures the safety of such an apparatus 1 in all circumstances. During the execution of sudden movements which may unload carriages 14 and 15, the running members 13 then come into engagement with the counter rails 27 and 28 overhanging the running strips 11 and 12 to prevent the carriages from rising from strips 11 and 12.

In a preferred embodiment, the anti-derailment plates extend towards each other and close up more or less completely and form the top 29 of base 2 between paths 5 and 6.

According to a characteristic of the invention, the above mentioned "side taking" means consist of stops 30 and 31 provided under and on each side of the shoes and descending on each side of the carriage to a level slightly higher than the top 29 of base 2 so that, from a certain articulation of the shoes, one of their stops engages with the top 29 of base 2. In turn, movement of the carriage over the track is braked and even stopped by friction, thus accurately simulating the sensation of "taking the edge".

To reinforce the braking, said top 29 is preferably provided with anti-skid means 32 such as integrally molded reliefs or by sanding.

In a preferred embodiment and to prevent their wear, these non skid means will be simply bonded to the top 29 of base 2.

The stops 30 and 31 of the shoe have obviously a spacing "E" greater than the width "L" of the top 16 of the carriage so as to preserve at least a certain amplitude of rotation of the shoe about a vertical axis passing through the ball joint 17.

Because of the particular form of base 2, and depending on the azimuth orientation about a vertical to the ball joint 17 of the line of greatest slope of the shoe, the carriage benefits from a variable freedom before meeting an obstacle such as the top 29 of said base 2.

Figure 7:
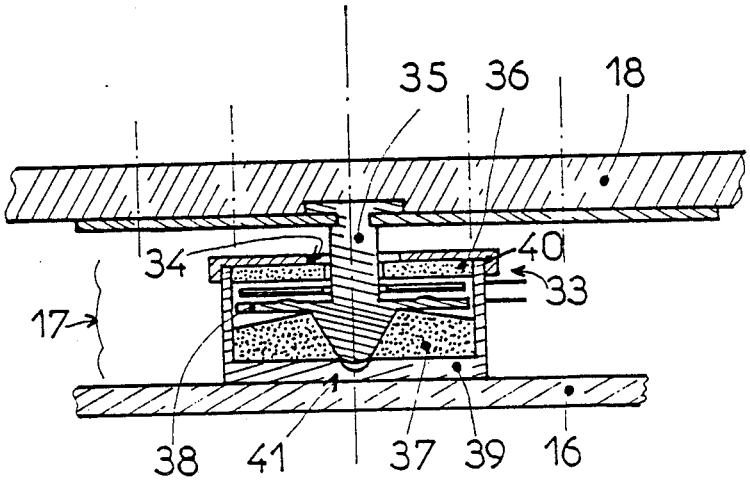
FIG. 7: a sectional view of the ball joint.

So that such a meeting does not take place outside the "edge taking" movements (particularly during forward or rearward slanting of the shoe), the shoe and the carriage are provided with means 33 (FIG. 7) limiting the movements of the ball joint proportionally to the freedom left in all directions. For example, these means 33 consists of a calotte, associated with the carriage, covering the ball joint and having an opening 34 substantially elliptic in shape whose largest axis is oriented across the shoe 14 and 15. Thus, the part 34 of the ball joint articulation 17 which is integral with shoe 18 is, in its slanting movement with respect to the carriage, limited essentially longitudinally but not transversally (or at least it is more limited longitudinally than transversally).

The calotte 33 may be removably fixed so as to facilitate the interchangeability thereof, for example for offering different limits.

Furthermore, for limiting the friction, the ball joint will be advantageously of a type having a part 35 (FIG. 7) in the form of a conical spindle bearing by its top on the top of a conical cup 41 having a larger angle at the top than that of the spindle 35.

In a preferred embodiment, the slanting movement of the shoe with respect to the carriage is controlled by means of a shock absorber 36 and 37 such as a compressible element inserted between a collar 38 solidly fixed to a part of the ball joint such as that associated with the shoe. At least one plate 39 and 40 is firmly fixed to another part of the ball joint such as that associated with the carriage, allows the resistance to penetration into the snow to be represented.

Although the compressible element may consist of a spring, in a preferred embodiment it will be formed of a block of synthetic plastic material foam having self lubricating qualities such as polyurethane.

So as not to hinder the movements for example during "taking the edge" movements and nevertheless, at that time, simulate the reaction created by the snow, the compressible element has a central bore mating with the shape of the spindle whereas the external face opposite the collar has a slightly conical shape so as to enter into contract with said collar only beyond a certain slant up to which the shock absorber is therefore limited to radial crushing of the block.

This embodiment allows strain gauges to be placed between the collar and the shock absorber measuring the amplitude of the slant and its orientation for example so as to serve as data supplied to a display and/or recording assembly.

In a variant, in order to assist the user in some of his movements along the track, with each carriage there is associated a control member 42 (FIG. 8) connected to base 2.

For example, it will be a question of simple return springs acting in a chosen direction, and, particularly, towards the raised ends of the track.

The spring (not shown) may act directly or indirectly such as, for example, on a reel 43 of a traction strap 44 (FIG. 8).

Such a strap and reel mechanism may, even without significant tension, be used for informing peripheral equipment about the position of the carriage along the track.

For controlling the carriage, an air cylinder or single or double acting cylinder 45 (FIG. 9) may also be used.

For connection to the control member 42 the carriage has a lug 46 (FIG. 5) passing through the aperture 47 left for this purpose between the anti-derailment plates 25 and 26 closing and forming the top 29 of the base.

Advantageously, the apparatus may include means 48 constantly braking each carriage for example for facilitating initiation.

Each adjustable brake 48 will include for example a screw 49 passing through a tapped hole in the carriage and bearing through a shoe on at least one wheel 13 of said carriage.

Alternatively, in order to embellish the simulated course with reliefs, in the form of bosses, or hollows, in a preferred embodiment, under at least one of the running strips 11 and 12 is inserted a member 50 locally modifying the level of said running strip 11 and 12 with respect to the rest of its length.

This running strip consists of a rail formed in several sections hinged to each other about horizontal axes perpendicular to the rail and members 50 consists of an eccentric 51 bearing the rail preferably at a junction between two section. The eccentric is controlled in rotation by a shaft 52 passing through the edge 7 and 8 of the base and having externally a crank handle 53.

To give users greater stability, holes will be provided in base 2, so that the user can engage ski sticks therein a guard rail, particularly during use for training.

At least one other hole (not shown) may be provided in one of the main edges contiguous with path 5 for fitting therein at least one cross piece. The cross piece provides in the vicinity of the edge, and externally of the apparatus, an anchorage point simulating the securing point of the rear of a boat.

In a further embodiment, two cross pieces will be used formed by the ski sticks.

On the top 29, stops, possibly removable, may obviously limit the free movement of the carriage.

I claim:

1. Muscle training apparatus allowing a user to exercise lower limbs comprising a base (2) providing the user with a training position with respect to a reference surface (3) on which the base is located, the base having an arcuate shaped track (4) with front and rear sides and lateral ends, and formed of two concentric paths (5, 6), one path (5) of which is an external path and the other path (6) is an internal path, the paths (5, 6) being carried by main sections (7, 8) of the base, and the main sections (7, 8) being connected together by end sections (9, 10) of the base, two running strips on the paths (5,6) comprising curved concentric rails (11,12), at least one moveable carriage (14, 15) bearing on said running strips with running members (13), the carriage having, in profile, a U shape and legs to which the running members (13) are connected, a shoe (18) connected to an upper part (16) of the carriage by an articulation means (17), the shoe (18) being adapted to receive a foot of the user and the articulation means (17) being formed to allow rotation of the shoe about an axis, and braking means on the shoe for braking, at least over a certain extent of the rotation, the movement of the carriage over the track so as to simulate the result in alpine skiing of an edge taking technique, the apparatus being formed as to place the user in a position corresponding to one actually taken during practice of skiing, despite the resultant guidance of the paths, wherein the track rises at one of its front or rear sides and at both lateral ends, wherein the paths have internal (19) and external (20) sides with respect to a center of the base (2) formed by internal (21) and external (22) dividing walls, each path (5,6) being situated at the bottom of a groove (23, 24) having a width scarcely greater than that of the running members (13) and the legs of the carriage, and wherein on a top of each of the internal dividing walls (21) of the paths (5, 6) there is fixed, by removable means, an anti-derailment plate (25, 26) provided, all along the path, with a counter rail (27, 28) descending towards the running strip of the corresponding path (5 or 6) to a height (H) scarcely greater than that of the running member (13).

2. Muscle training apparatus allowing a user to exercise lower limbs comprising a base (2) providing the user with a training position with respect to a reference surface (3) on which the base is located, the base having an arcuate shaped track (4) with front and rear sides and lateral ends, and formed of two concentric paths (5, 6), one path (5) of which is an external path and the other path (6) is an internal path, the paths (5, 6) being carried by main sections (7, 8) of the base, and the main sections (7, 8) being connected together by end sections (9, 10) of the base, two running strips on the paths (5, 6) comprising curved concentric rails (11, 12), at least one movable carriage (14, 15) bearing on said running strips with running members (13), the carriage having, in profile, a U shape and legs to which the running members 913) are connected, a shoe (18) connected to an upper part (16) of the carriage by an articulation means (17), the shoe (18) being adapted to receive a foot of the user and the articulation means (17) being formed to allow rotation of the shoe about an axis, and braking means on the shoe for braking, at least over a certain extent of the rotation, the movement of the carriage over the track so as to simulate the result in alpine skiing of an edge taking technique, the apparatus being formed as to place the user in a position corresponding to one actually taken during practice of skiing, despite the resultant guidance of the paths, wherein the track rises at one of its front or rear sides and at both lateral ends, wherein the braking means comprises a stop (30, 31) provided under and on the shoe and descending from the carriage to a level slightly higher than a top (29) of the base (2) so that, from a certain articulation of the shoe, the stop engages the top (29) of the base (2) so that, by friction, the movement of the carriage over the track is braked, thus simulating the sensation of an edge taking movement.

3. Apparatus according to claim 2, wherein, for reinforcing the braking, said top (29) is provided with non-skid means (32).

4. Muscle training apparatus allowing a user to exercise lower limbs comprising a base (2) providing the user with a training position with respect to a reference surface (3) on which the base is located, the base having an arcuate shaped track (4) with front and rear sides and lateral ends, and formed of two concentric paths (5, 6), one path (5) of which is an external path and the other path (6) is an internal path, the paths (5, 6) being carried by main sections (7, 8) of the base (2), and the main sections (7, 8) being connected together by end sections (9, 10) of the base, two running strips on the paths (5, 6) comprising curved concentric rails (11, 12), at least one moveable carriage (14, 15) bearing on said running strips with running members (13), the carriage having, in profile, a U shape and legs to which the running members (13) are connected, a shoe (18) connected to an upper part (16) of the carriage by an articulation means (17), the shoe (18) being adapted to receive a foot of the user and the articulation means (17) being formed to allow rotation of the shoe about an axis, and braking means on the shoe for braking, at least over a certain extent of the rotation, the movement of the carriage over the track so as to simulate the result in alpine skiing of an edge taking technique, the apparatus being formed as to place the user in a position corresponding to one actually taken during practice of skiing, despite the resultant guidance of the paths, wherein the track rises at one of its front or rear sides and at both lateral ends, wherein, under at least one of the running strips (11, 12), there is inserted a member (50) modifying locally a level of a portion of said running strip (11, 12) with respect to the rest of the strip in order to simulate reliefs.

5. Muscle training apparatus allowing a user to exercise lower limbs comprising a base (2) providing the user with a training position with respect to a reference surface (3) on which the base is located, the base having an arcuate shaped track (4) with front and rear sides and lateral ends, and formed of two concentric paths (5, 6), one path (5) of which is an external path and the other path (6) is an internal path, the paths (5, 6) being carried by main sections (7, 8) of the base, and the main sections (7, 8) being connected together by end sections (9, 10) of the base, two running strips on the paths (5, 6) comprising curved concentric rails (11, 12), at least one moveable carriage (14, 15) bearing on said running strips with running members (13), the carriage having, in profile, a U shape and legs to which the running members (13) are connected, a shoe (18) connected to an upper part 916) of the carriage by an articulation means (17), the shoe (18) being adapted to receive a foot of the user and the articulation means (17) being formed to allow rotation of the shoe about an axis, and braking means on the shoe for braking, at least over a certain extent of the rotation, the movement of the carriage over the track so as to simulate the result in alpine skiing of an edge taking technique, the apparatus being formed as to place the user in a position corresponding to one actually taken during practice of skiing, despite the resultant guidance of the paths, wherein the track rises at one of its front or rear sides and at both lateral ends, wherein the articulation means (17) carried by the carriage and receiving the shoe is of the ball joint type, and wherein, under at least one of the running strips (11, 12), there is inserted a member (50) which modifies locally a level of a portion of said running strip with respect to the rest of the strip in order to simulate reliefs.

* * * * *